US007712638B2

(12) United States Patent
Kick

(10) Patent No.: US 7,712,638 B2
(45) Date of Patent: May 11, 2010

(54) DUAL OVERLAPPING FLIP TOP CLOSURE ASSEMBLY

(75) Inventor: James Kick, Town & Country, MO (US)

(73) Assignee: C.A.P.S., Inc., Town & Country, MO (US)

( * ) Notice: Subject to any disclaimer, the term of this patent is extended or adjusted under 35 U.S.C. 154(b) by 376 days.

(21) Appl. No.: 11/777,750

(22) Filed: Jul. 13, 2007

(65) Prior Publication Data

US 2008/0230543 A1 Sep. 25, 2008

Related U.S. Application Data

(63) Continuation-in-part of application No. 29/278,256, filed on Mar. 23, 2007, now Pat. No. Des. 565,408.

(51) Int. Cl.
*B67D 3/00* (2006.01)

(52) U.S. Cl. ..... 222/480; 222/565

(58) Field of Classification Search ..... 222/480, 222/457.5, 142.1, 151, 565, 546, 487, 489, 222/543, 153.06, 153.07; 220/265–267, 220/255.1, 257.1, 257.2, 258.3, 258.5, 254.2–254.4
See application file for complete search history.

(56) References Cited

U.S. PATENT DOCUMENTS

| | | | | |
|---|---|---|---|---|
| 3,187,964 | A * | 6/1965 | Foster | 222/480 |
| 3,254,811 | A * | 6/1966 | Harris | 222/541.6 |
| 4,291,818 | A | 9/1981 | Nozawa et al. | |
| 4,361,250 | A | 11/1982 | Foster | |
| 4,403,712 | A | 9/1983 | Wiesinger | |
| 4,545,508 | A | 10/1985 | Cribb, Jr. et al. | |
| 4,936,494 | A | 6/1990 | Weidman | |
| D331,878 | S | 12/1992 | Forsyth | |
| RE34,263 | E | 5/1993 | vanKerkhoven et al. | |
| D340,187 | S | 10/1993 | Forsyth | |
| 5,330,082 | A | 7/1994 | Forsyth | |
| 5,975,368 | A * | 11/1999 | Wood | 222/151 |
| RE37,634 | E | 4/2002 | Hickman et al. | |
| 6,382,476 | B1 * | 5/2002 | Randall et al. | 222/545 |
| 6,510,971 | B1 | 1/2003 | Martin | |
| D476,892 | S | 7/2003 | Martin | |
| D532,298 | S | 11/2006 | Vogel | |
| D537,341 | S | 2/2007 | Liebe et al. | |
| 2002/0125203 | A1 | 9/2002 | Bried et al. | |
| 2006/0237388 | A1 | 10/2006 | Kick | |

* cited by examiner

*Primary Examiner*—Lien T Ngo
(74) *Attorney, Agent, or Firm*—Polster, Lieder, Woodruff & Lucchesi, L.C.

(57) ABSTRACT

A closure for a container having a mouth wherein the closure is adapted for sealable connection to the mouth of the container and includes an end wall at the upper end of the skirt for closing the mouth when the closure is mounted to the container. The closure includes an opening in the end wall for dispensing a product held by the container and a first flap that has at least one flap aperture that is smaller than the opening. The first flap is adapted for selectively opening and closing the opening. A second flap is adapted for overlaying the first flap and includes a first state wherein one or more of the flap apertures in the first flap are open and a second state wherein the flap apertures in the first flap are sealed.

25 Claims, 3 Drawing Sheets

DUAL OVERLAPPING FLIP TOP CLOSURE ASSEMBLY

CROSS-REFERENCE TO RELATED APPLICATIONS

This application is a continuation-in-part of U.S. Design patent application Ser. No. 29/278,256, filed on Mar. 23, 2007, and entitled DUAL OVERLAPPING FLIP TOP CLOSURE. The disclosure of the above application is incorporated herein by reference.

FIELD

The present disclosure relates to closures for containers and, more specifically, to a closure for containers for exposing one or more product dispensing holes through which a product held by the container may be poured, shaken and spooned from the container.

BACKGROUND

The statements in this section merely provide background information related to the present disclosure and may not constitute prior art.

Typically, containers for holding a product to be poured, shaken and spooned have a cap or closure that is adapted for securing to the container by a snap or threaded engagement. The closures, such as dispensing caps, typically have a plurality of holes through which the product can be shake dispensed, e.g., shaken. A flap is often provided for overlaying on the plurality of holes to seal or close the holes when not in use. The closures can also have a separate aperture adapted for pouring and spooning the product from the container. The aperture is often dimensioned for receiving a spoon and for enabling the user to withdraw the spoon with a predetermined amount of product or at least a leveled amount of product. This aperture is provided with a separate flap. The two flaps are located on opposing sides of the closure for separate operation by the user.

SUMMARY

The inventor hereof has succeeded at designing new and novel closures for containers that allow for a product to be shaken, poured and spooned in a different manner thereby providing for improved operation of the closures by users in some embodiments and uses. Additionally, in some embodiments such closures can provide for reduced manufactured costs.

According to one aspect, in a closure for a container having a mouth the closure is adapted for sealable connection to the mouth of the container and includes an end wall at the upper end of the skirt for closing the mouth when the closure is mounted to the container. The closure includes an opening in the end wall for dispensing a product held by the container and a first flap that has at least one flap aperture that is smaller than the opening. The first flap is adapted for selectively opening and closing the opening. A second flap is adapted for overlaying the first flap and includes a first state wherein one or more of the apertures in the first flap are open and a second state wherein the apertures in the first flap are sealed.

According to another aspect, a dispensing cap for a container having a mouth at an end of the container includes a downwardly depending skirt for sealable connection to the mouth of the container and an end wall at the upper end of the skirt for closing the mouth of the container when the closure is mounted to the container. The end wall has an opening for dispensing a product held by the container and a first flap with a plurality of small apertures. The first flap is hingedly attached to the end wall proximate to the opening. The first flap is adapted for selective movement between a closed position in which the first flap seals the opening and an opened position in which the first flap is free from the opening for enabling the product held by the container to pass through the opening. A second flap is hingedly connected to the end wall. The second flap is adapted for selective movement between a closed position in which the second flap overlies the first flap and seals the small apertures in the first flap and an opened position in which the second flap is free of the first flap. In the opened position, the second flap unseals the small apertures in the first flap for enabling the passing of the product through the small apertures.

According to yet another aspect, a dispensing cap for a container having a mouth includes a downwardly depending skirt for sealable connection to the mouth of the container and an end wall at the upper end of the skirt for closing the mouth when the closure is mounted to the container. The cap includes an opening in the end wall for dispensing a product held by the container and means for providing selective access to a product held by the container wherein the selective access includes a closed position preventing access to the product. The cap also includes means for permitting the product to be shake dispensed from the container when the means for providing access is closed. The cap further includes means for closing the means for providing limited dispensing of the product.

Further aspects of the present disclosure will be in part apparent and in part pointed out below. It should be understood that various aspects of the disclosure may be implemented individually or in combination with one another. It should also be understood that the detailed description and drawings, while indicating certain exemplary embodiments, are intended for purposes of illustration only and should not be construed as limiting the scope of the disclosure.

BRIEF DESCRIPTION OF THE DRAWINGS

It should be understood that throughout the drawings, corresponding reference numerals indicate like or corresponding parts and features.

DETAILED DESCRIPTION

Figure 1:
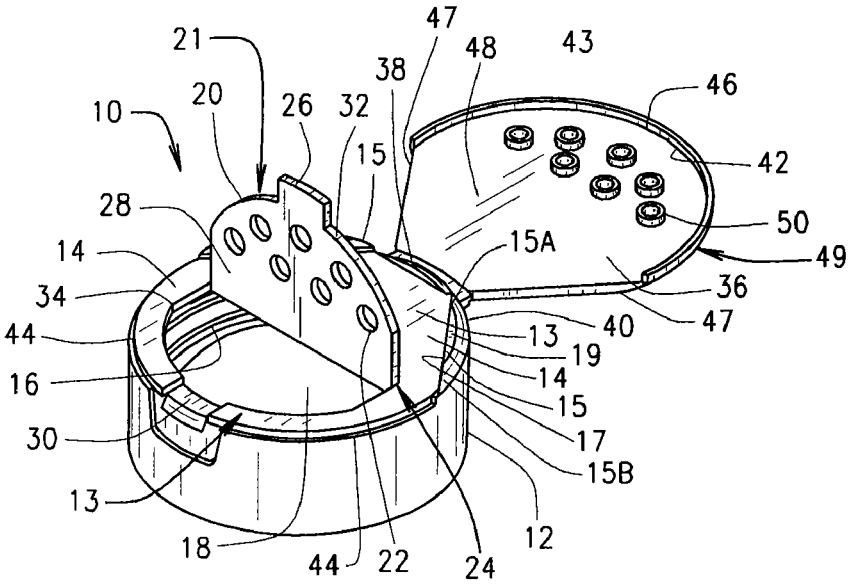
FIG. 1 is side perspective view of a closure having dual overlapping flaps according to one exemplary embodiment.
Figure 2:
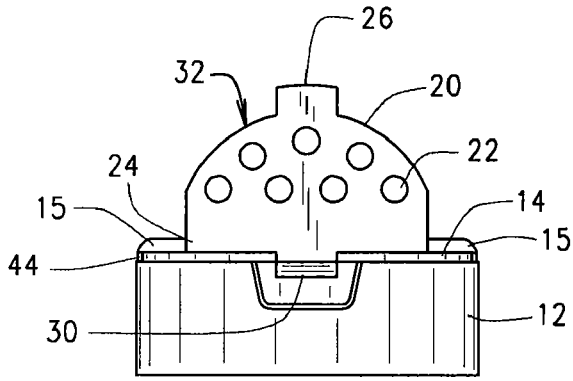
FIG. 2 is a front view of the closure of FIG. 1 according to one exemplary embodiment.
Figure 3:
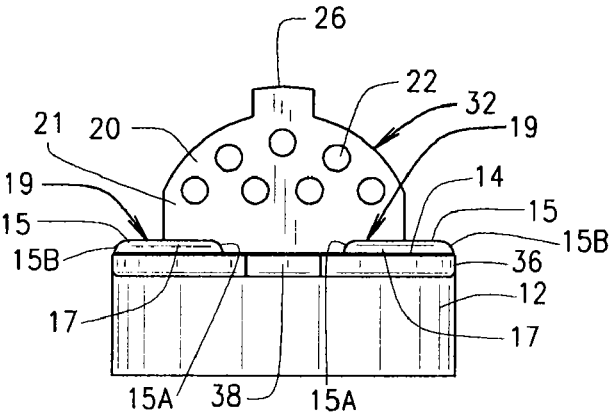
FIG. 3 is a back view of the closure of FIG. 1 according to one exemplary embodiment.
Figure 4:
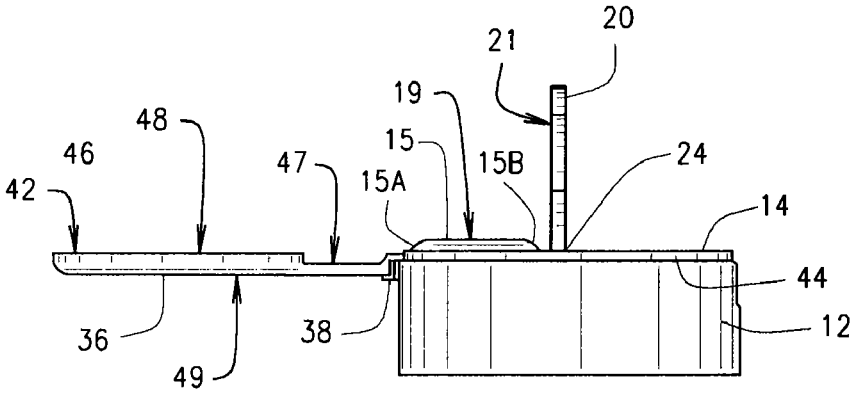
FIG. 4 is a side view of the closure of FIG. 1 according to one exemplary embodiment.

The following description is merely exemplary in nature and is not intended to limit the present disclosure or the disclosure's applications or uses.

As shown by way of examples is FIGS. 1-8. in various embodiments of a closure 10 or cap for a container (not shown), the closure 10 is adapted for sealable connection to a mouth of the container and for dispensing product (not shown) contained within the container without removal of the closure 10 or cap from the container. The closure 10 includes a skirt 12 defining a perimeter of the closure 10 and a diametric or generally diametric end wall 14 at an upper end of the skirt 12. The closure 10 is configured for closing the mouth of the container when the closure 10 is mounted to the container. In some embodiments, the closure 10 can include a snap locking mechanism (not shown) for coupling to the container. Additionally, where the container has a threaded neck, the skirt 12 of the closure 10 can include threads 16 that are configured for being threaded onto the threaded neck of the container.

The closure 10 includes one or more openings 18 in the end wall 14 for dispensing a product held by the container. In some embodiments, this is a single opening 18 configured for pouring or spooning of the product. In some embodiments, the opening 18 in the end wall 14 can be shaped and dimensioned to accept a spoon for extracting product held by the container. For example, the opening 18 can have the shape of a half-circle for spooning of the product from the container as shown by way of example in FIG. 1. The one or more openings 18 can be of any size relative to the total size of the end wall 14, and can include, in one embodiment, a single opening 18 dimensioned to be a substantial portion of one-half of a total area of the end wall 14. Other shapes and sizes are also possible for the openings 18 including a single opening 18 that includes a circle (as shown by way of example in FIG. 7) or a square that has a cross-sectional area of a substantial portion of the total area of the end wall (as shown by way of another example in FIG. 8).

Figure 5:
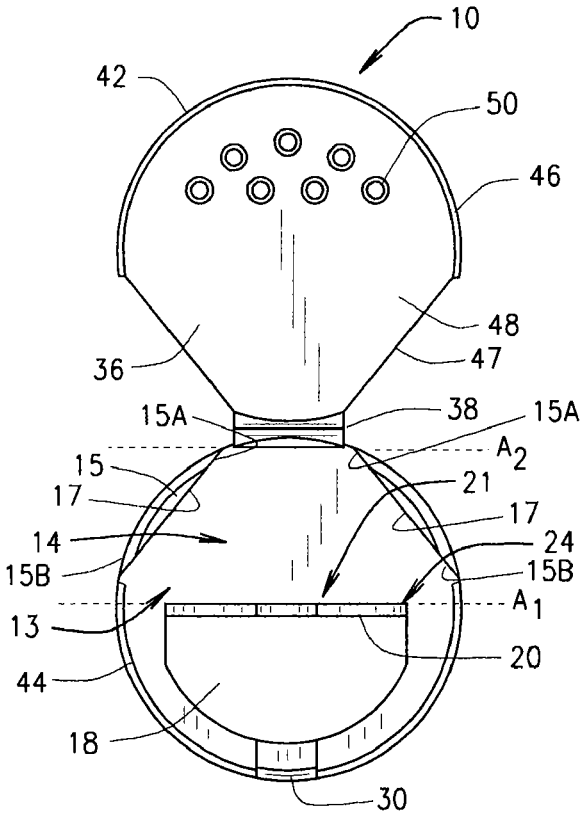
FIG. 5 is a top view of the closure of FIG. 1 according to one exemplary embodiment.
Figure 6:
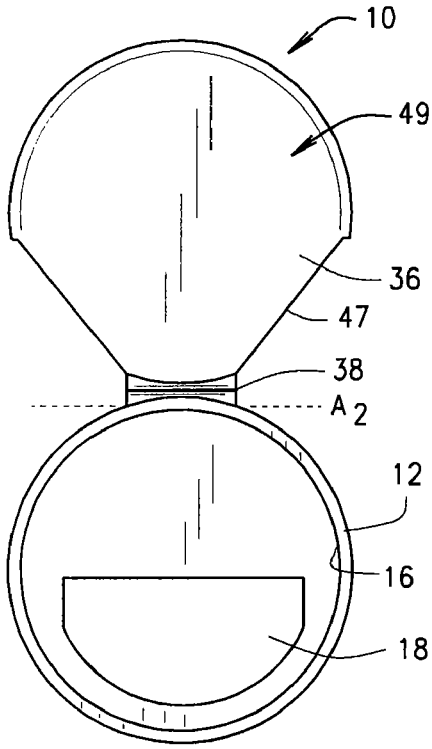
FIG. 6 is a bottom view of the closure of FIG. 1 according to one exemplary embodiment.
Figure 7:
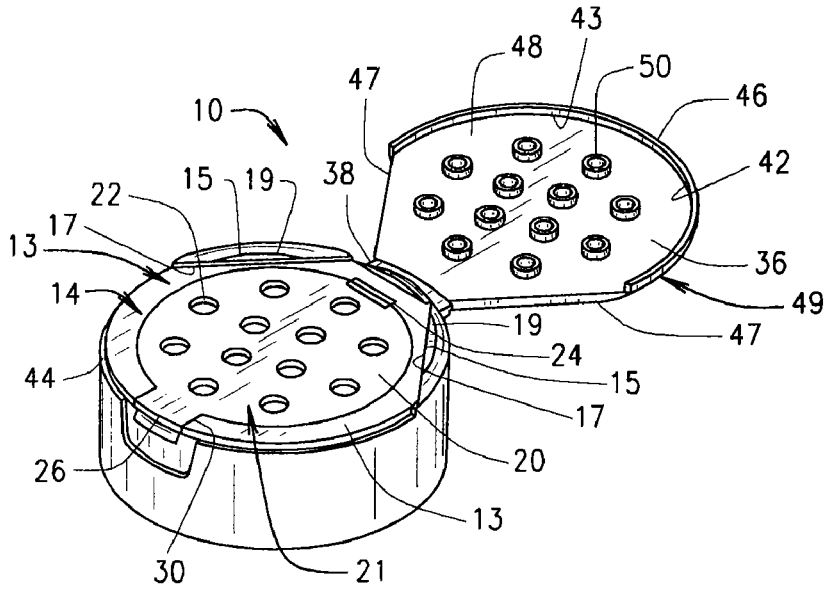
FIG. 7 is a top perspective view of a closure having dual overlapping flaps according to a second exemplary embodiment.
Figure 8:
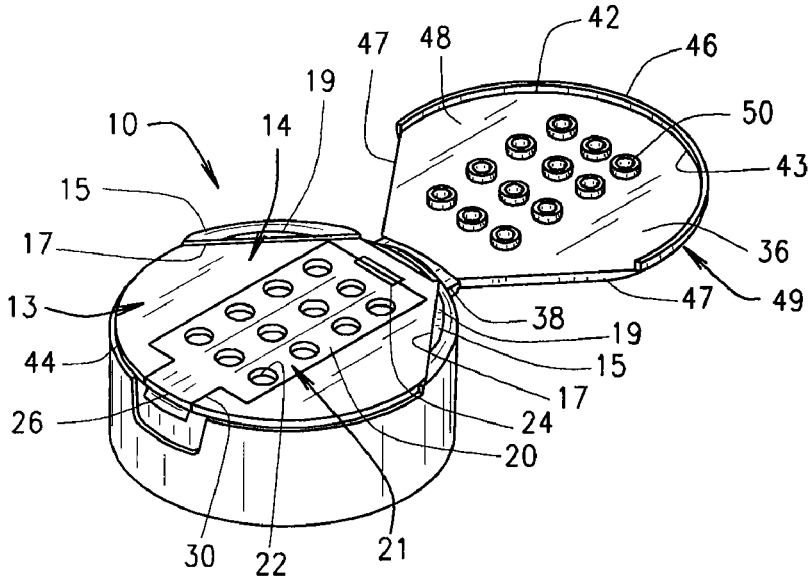
FIG. 8 is a top perspective view of a closure having dual overlapping flaps according to a third exemplary embodiment.

A first flap 20 has more apertures 22 that are smaller in size than the one or more openings 18. The first flap 20 is adapted for selectively opening and closing the one or more openings 18 and includes a top surface 21 and an outer edge. This can include, in some embodiments, a first hinge 24 that attaches the first flap 20 to the end wall 14 and provides for rotational movement about a first axis A1 that is relative to the plane defined by the end wall 14 (as shown in FIG. 5). The rotation movement of the first flap 20 is in a first orientation towards the outer edge of the first flap 20. This hinge 24 provides for the selective movement of the first flap 20 between a first state and a second state. The first state is where the first flap 20 is positioned within the openings 18 for substantially closing the openings 18 and a second state with the first flap 20 being removed from the openings 18. In this first state, the top surface 21 of the first flap 20 is substantially planar with the outer surface 13 of the end wall 14. As illustrated in FIG. 1 the first flap 24 extends outwardly and can include a perpendicular position for allowing for the unrestricted flow of the product out of the container or allowing a user to use a utensil to advance through the opening 18 and into the container to remove measured amounts of the product. The hinge 24 can be positioned between the first flap 20 and the end wall 14 in any manner or method or position including being spaced apart from the periphery or perimeter of the closure 10. In some embodiments, the hinge 24 is proximate to the opening 18 such as forming a portion of the end wall 14 defining the opening 18. This can be formed in any manner, including formation by and/or during injection or other molding, by way of example.

Additionally, the first flap 20 can also include a finger tab 26 that extends outwardly from the first flap 20, or at least a main body 28 of the first flap 20. The end wall 14 can include a corresponding cavity 30 that is configured to receive the tab 26 when the first flap 20 is positioned within the openings 18. In such a position the tab 26 and the cavity 30 permit a user to readily insert a portion or tip of a finger in the cavity 30 for opening the first flap 20 via the tab 26. In some embodiments, the first flap 20 can include side edges 32 configured to engage edges 34 of the openings 18 when the first flap 20 is positioned within the openings 18. Such first flap edges 32 can include a protrusion (not shown) configured for snapping into crevices (not shown) on the side edges 34 of the openings 18.

A second flap 36 is adapted for overlaying the first flap 20 and includes a first state wherein one or more of the apertures 22 in the first flap 20 are open and a second state wherein the apertures 22 in the first flap 20 are sealed. A second hinge 38 attaches the second flap 36 to the end wall 14 for selective rotational moving the second flap 36 in a second orientation about a second axis A2 (as shown in FIG. 5) from the first state to the second state. The first state of the second flap 36 can be one that wherein the second flap 36 overlays the first flap 20 in the same direction and orientation and substantially closes the first flap apertures 22. In such embodiments, the orientation of the rotating first flap 20 is the same orientation of the rotating second liar 36. The second state of the second flap 36 can be one that uncovers the first flap 20 and opens one or more apertures 22 of the first flap 20. In one embodiment, this second state can include opening of all of the apertures 22 of the first flap 20 to provide for the shake dispensing of the product from the container through the first flap apertures 22. The hinge 38 can be configured in any position as may be provided or required by the size and shape of the second flap 36 and/or the end wall 14. For example, where the second flap 36 has a cross-sectional area about equivalent to the total cross sectional area of the closure 10, the hinge 38 can be attached proximate to a periphery 40 of the end wall 14. In other embodiments, the second flap 36 is smaller or has a cross sectional area that is less than the cross-sectional area of the end wall 14. in those embodiments, the hinge 38 could be located at a distance from the periphery 40 of the end wall 14 or could also be located proximate to the periphery 40 as shown by way of example in FIG. 8.

As shown in FIGS. 1-8, the second flap 36 includes a top surface 49 that is dimensioned such that the top surface 49 of the second flap 36 is substantially planar with the top surfaces 19 of the abutments 18 when the second flap 36 is in the closed position (second state). Additionally, in some embodiments the second flap 36 is dimensioned to overlay the outer surface 13 of the end wall 14 and the top surface 21 of the first flap 20 and lie between the two abutments 15. In such embodiments, the second flap includes two straight peripheral edges 47 each of which angles outwardly from each side of second hinge 38 and a substantially semicircular outer edge that defines a downwardly depending skirt 46 on an outer edge opposing the second hinge 38. The two straight peripheral edges 47 are dimensioned and configured for placement between the two inner edges 17 of the abutments 15 when the second flap 36 is in the closed or second state overlaying the top surface of the first flap 20 and the outer surface 13 of the end wall 14.

The second flap 36 can include a snap lock mechanism 42 that is dimensioned and or configured for securing the second flap 36 in its closed position overlaying the first flap 20. The end wall 14 and or skirt 12 can include or define a shoulder 44 integrally formed about a top or peripheral portion for coupling to a downwardly protruding skirt 46. A portion of a periphery of the second flap skirt 46 is configured to selectively engage with the shoulder 44 of the end wall 14. In some embodiments, the skirt 46 of the second flap 36 can include an internal beveled edge 43 for engaging the shoulder 44 of the end wall 14 or a portion of the end wall 14 defined by the shoulder 44. The second flap 36 can also include an inner surface 48 with one or more bosses 50. Each boss 50 can he configured to be received within a respective aperture 22 of the first flap 20 for closing the apertures 22 when the second flap 36 overlays the first flap 20.

As shown in this description and in the accompanying FIGS. 1-8, in operation of the closure 10, when the second flap 36 is closed, the first flap 20 is also closed. As such, all of the openings 18 and the apertures 22 are closed and the closure 10 seals the container such that no product is dispensed from the container. If a user wishes to shake or sprinkle out a small or individual quantity of the product, the user opens the second flap 36 about the second hinges 38. By doing so, the bosses 50 are withdrawn from the apertures 22 whereby they become open for enabling the product to be dispensed there through. The user can then close the second flap 36 when done to reseal the container. However, if the user wishes to withdraw a substantial amount of product from the container, the user can grasp the tab 26 of the first flap 20 and rotate the first flap 20 about the first hinge 24 to withdraw the first flap 20 from the opening 18. Once the first flap 20 is removed from the opening 18, the user can pour the product through the opening 18 or can insert a spoon or knife or the like through the opening 18 to withdraw a portion of the product. When the user has withdrawn the desired amount of product through the opening 18, the user can either close the first flap 20 to seal or close the opening 18. At this time the user can still shake a smaller amount of product through the apertures 22. In the alternative, the user can close the second flap 36 to insert the bosses 50 into to the apertures 22 to seal the apertures 22 and close the container. These operations do not require that the user turn the container or closure at both the first flap 20 and the second flap 36 can open in the same direction. In other embodiments, the first flap 20 can open in the opposite or a different position than the second flap 36 as the current disclosure provides for such design of the closure with dual overlapping flaps is flexible for meeting the particular needs or desires of container and product manufactures and users.

When describing elements or features and/or embodiments thereof, the articles "a", "an", "the", and "said" are intended to mean that there are one or more of the elements or features. The terms "comprising", "including", and "having" are intended to be inclusive and mean that there may be additional elements or features beyond those specifically described.

Those skilled in the art will recognize that various changes can be made to the exemplary embodiments and implementations described above without departing from the scope of the disclosure. Accordingly, all matter contained in the above description or shown in the accompanying drawings should be interpreted as illustrative and not in a limiting sense.

It is further to be understood that the processes or steps described herein are not to be construed as necessarily requiring their performance in the particular order discussed or illustrated. It is also to be understood that additional or alternative processes or steps may be employed.

What is claimed is:

1. A closure for a container having a round mouth, the closure for sealable connection to the mouth of the container and for dispensing a product from the container, the closure comprising:

a monolithic cylindrical body having a skirt with an upper end and defining a perimeter of the closure, an end wall having a substantially planar outer surface and a pair of opposing abutments extending upward from the outer surface of the end wall and from opposing portions of the skirt and having a top abutment surface, the end wall coupled about the perimeter of the upper end of the skirt for closing the mouth of the container when the closure is mounted to the container, the monolithic body further including first flap, a first hinge, a second flap and a second hinge and an opening in the end wall fur dispensing a product held by the container;

the first flap having at least one aperture that is smaller than the opening, the first flap centered relative to a line between the pair of opposing abutments and being adapted for selectively opening and closing the opening;

the first hinge coupling the first flap to the upper surface of the end wall spaced apart from a periphery of the end wall for rotatable movement of the first flap relative to the end wall, the first flap having an outer edge opposing the first hinge in a first orientation; and the second flap adapted for overlaying the first flap and the outer surface of the end wall between the air of abutments and having a first state wherein one or more of the apertures in the first flap are open and a second state wherein the apertures in the first flap are sealed, the second hinge coupling the second flap to the body about a periphery for rotatable movement of the second flap relative to the end wall in a second orientation that is the same as the first orientation, and wherein the second flap includes two opposing straight edges each of which angles outwardly from opposing sides of the second hinge, the two straight edges dimensioned for positioning between the pair of abutments when the second flap is in the second state, the second flap including a substantially semicircular outer edge between the two straight edges and opposite of the second hinge.

2. The closure of claim 1 wherein the opening in the end wall is a single opening dimensioned to be a substantial portion of one-half of the total circular area with the perimeter of the circular body.

3. The closure of claim 1 wherein the opening in the end wall is dimensioned to be a substantial portion of a total area of the outer surface of the end wall other than the two abutments.

4. The closure of claim 1, wherein the second hinge is configured for selectively moving the second flap from a first state that overlays the first flap with the outer surface of the end wall having the outer surface of the second flap substantially planar with the top surface of the abutments and substantially closing the first flap apertures and a second state that uncovers the first flap and opens one or more first flap apertures.

5. The closure of claim 4 wherein the second hinge is attached proximate to a periphery of the end wall.

6. The closure of claim 1 wherein the first flap includes a finger tab at the outer edge that extends outwardly from the outer edge of the first flap and wherein the end wall includes a cavity in the outer surface opposite of the second hinge the cavity being configured for receiving the tab of the first flap when the first flap is positioned within the opening, the tab and cavity configured for permitting an end user to readily insert a finger in the cavity and to open the first flap via the tab.

7. The closure of claim 6 wherein the second flap includes a snap lock mechanism for securing the second flap in its closed position overlaying the first flap and the outer surface of the end wall and between the two abutments.

8. The closure of claim 1 wherein the second flap includes a snap lock mechanism for securing the second flap in its closed position overlaying the first flap and the outer surface of the end wall.

9. The closure of claim 1 wherein the container has a threaded neck, and wherein the skirt includes threads configured for being threaded onto the threaded neck of the container.

10. The closure of claim 1 wherein the first flap has side edges configured to engage edges of the opening when the first flap is positioned within the opening, and wherein the upper surface of the first flap is substantially coplanar with the substantially planar outer surface of the end wall when the first flap is in the first state.

11. The closure of claim 1, further comprising a snap lock mechanism for retaining the second flap in a closed position wherein the snap lock mechanism includes the outer surface of the end wall having a shoulder integrally formed about a top peripheral portion and the second flap having a downwardly protruding skirt about the substantially semicircular outer edge of the second flap, the second flap skirt configured to selectively engage with the shoulder of the end wall.

12. The closure of claim 11 wherein the skirt of the second flap includes an internal beveled edge for engaging an outer edge of the shoulder of the end wall.

13. The closure of claim 1 wherein the second flap includes an inner surface with one or more bosses, each boss being configured to be received within a respective one of the first flap apertures for closing the apertures when the second flap overlays the first flap.

14. The closure of claim 1 wherein the opening in the end wall is dimensioned to include a half circle portion configured to accept a spoon for extracting product held by the container.

15. A dispensing cap for a container having a round mouth at an end of the container comprising:

a monolithic cylindrical body having a downwardly depending skirt for sealable connection to the mouth of the container and end wall, a first flap with a first hinge and a second flap with a second hinge;

the end wall at the upper end of the skirt for closing the mouth of the container when the closure is mounted to the container, the end wall having an opening for dispensing a product held by the container, the end wall having a substantially planar outer surface and a pair of opposing abutments extending upward from the outer surface of the end wall and from opposing portions of the skirt and having an top abutment surface and defining to outwardly angled straight inner edges;

the first flap having a plurality of small apertures, the first flap being hingedly attached with a first hinge to the end wall proximate to the opening and adapted for selective rotational movement in a first orientation between a closed position in which the first flap seals the opening and an opened position in which the first flap is free from the opening for enabling the product held by the container to pass through the opening; and the second flap hingedly connected with a second hinge to the body for selective rotational movement in a second orientation between a closed position in which the second flap overlies the first hap and the substantially planar surface of the end wall and between the two outwardly angled straight inner edges of the abutments and seals the small apertures in the first flap and an opened position in which the second flap is free of the first flap, the planar surface of the end wall and the two inner edges of the abutments and unseals the small apertures in the first flap for enabling the passing of the product through the small apertures, the second orientation being the same as the first orientation.

16. The dispensing cap of claim 15 wherein the second flap includes an inner surface with bosses, each boss being configured to be received within one of the small apertures for closing the apertures when the second flap is in its closed position.

17. The dispensing cap of claim 15 wherein the first flap includes a tab extending outwardly from the first flap, the top surface of the end wall includes a cavity configured for receiving the tab of the first flap when the first flap is in its closed position and locking the first flap in the closed position.

18. The dispensing cap of claim 15 wherein the first flap is configured to be moved to a perpendicular position in the opened position for allowing for the unrestricted flow of the product out of the container or allowing a user to use a utensil to advance through the opening and into the container to remove measured amounts of the product.

19. The dispensing cap of claim 17 wherein the second flap includes a snap lock mechanism cooperable with the end wall for selectively securing the second flap in its closed position.

20. The dispensing cap of claim 19 wherein the snap lock mechanism includes the end wall having a shoulder integrally formed about a top peripheral portion and the second flap having a downwardly protruding skirt about a portion of a periphery of the second flap and having an internal beveled edge for snap lock engagement with the shoulder of the end wall.

21. The closure of claim 1 wherein each of the abutments extend upwardly from the skirt and having a proximal end on opposing sides of the second hinge, extend about a portion of the periphery to a distal end, and define a straight inner edge between the proximal end and the distal end, and wherein the two opposing straight edges of the second flap are dimensioned for positioning within the inner edges when the second flap is in the second state.

22. The closure of claim 21 wherein the second flap has an outer surface dimensioned to be substantially planar with the top surface of the abutments when the second flap is in the second state.

23. The closure of claim 1 wherein the first hinge defining a first axis for rotatable movement of the first flap in the first orientation and the second hinge defining a second axis for rotatable movement of the second flap in the second orientation, wherein the second hinge axis is parallel and offset from the first hinge axis.

24. The dispensing cap of claim 15 wherein each of the abutments extends upwardly from the skirt and has a proximal end on opposing sides of the second hinge, extends about opposing portions of the periphery of the end wall to a distal end, and defines a straight outwardly angled inner edge between the proximal end and the distal end, and wherein the two opposing outwardly angled straight edges of the second flap are dimensioned for positioning within and adjacent to the inner edges when the second flap is in the closed position.

25. The dispensing cap of claim 15 wherein the second flap has an outer surface dimensioned to be substantially planar with the top surface of the abutments when the second flap is in the closed position.

* * * * *